United States Patent [19]

Ploussios

[11] Patent Number: 4,924,238

[45] Date of Patent: May 8, 1990

[54] ELECTRONICALLY TUNABLE ANTENNA

[76] Inventor: George Ploussios, 4 Hackney Cir., Andover, Mass. 01810

[21] Appl. No.: 153,605

[22] Filed: Feb. 8, 1988

Related U.S. Application Data

[63] Continuation-in-part of Ser. No. 11,736, Feb. 6, 1987, abandoned.

[51] Int. Cl.[5] ..... H01Q 1/36

[52] U.S. Cl. ..... 343/802; 343/895

[58] Field of Search ..... 343/745, 747, 749, 750, 343/752, 802, 820, 857, 895

[56] References Cited

U.S. PATENT DOCUMENTS

| | | | |
|---|---|---|---|
| 3,089,140 | 5/1963 | Monola | 343/752 |
| 4,502,025 | 2/1985 | Carl et al. | 333/24 R |
| 4,564,843 | 1/1986 | Cooper | 343/745 |
| 4,656,483 | 4/1987 | Jaquet | 343/745 |

*Primary Examiner*—Rolf Hille
*Assistant Examiner*—Michael C. Wimer
*Attorney, Agent, or Firm*—E. T. Barrett

[57] ABSTRACT

A resonant helical antenna capable of being tuned electronically over a broad range of frequencies. The helical turns of the radiating portion of the antenna are formed of tubular material which may be in the form of a single length of tubing or may comprise a number of parallel coaxial cables with their outer conductors in electrical contact. The antenna is tuned by a series of oppositely poled pairs of diodes that are connected at spaced points to the radiating coils of the antenna. When the diodes are biased to be conducive, a section of the radiating helix is short-circuited. Bias voltages to control the diodes are provided by leads inside the radiating turns of the helix. Each lead for a pair of diodes emerges at a point electrically balanced between the two spaced points that are connected to the associated diodes. No r-f potential exists between the outer and inner conductor of the radiating runs at the point where the bias lead emerges, so no r-f current flows in the bias lead wires.

The antenna may include spaced cpacitance elements and may be in the form of a monopole helical antenna or it may be in the form of a dipole antenna with two oppositely-disposed arms.

8 Claims, 3 Drawing Sheets

ELECTRONICALLY TUNABLE ANTENNA

BACKGROUND OF THE INVENTION

1. Cross-Reference to Related Applications

This application is a continuation-in-part of U.S. application Ser. No. 07/011,736 filed Feb. 6, 1987, abandoned. This application is related to application Ser. No. 07/088,429 filed Aug. 24, 1987, now U.S. Pat. No. 4,862,184, which describes a physical structure embodying the principles of the invention described in the present application.

2. Field of the Invention

This invention relates to helical antenna structures and more particularly to resonant monopole antennas of helical configuration and to the electronic tuning of such antennas.

3. Description of the Related Art:

Various kinds of electrically short (less than onequarter wavelength long) antennas have been used both with and without top loading and with and without electrical tuning, U.S. Pat. No. 4,656,483 to Jaquet describes an antenna switchable between UHF and VHF bands. The antenna comprises a capacitive element spaced from a ground surface, an inductance inserted between the capacitive element and a crossing point of the ground surface that is connected to a transmitter or receiver. The antenna is adjusted for VHF band use by short-circuiting a portion of the inductance and for UHF use by short-circuiting all of the turns of the inductance. A second inductor is connected between the first inductance and the ground surface for VHF band use and is disconnected for UHF band use. Conductive side members are inserted between the capacitive member and the ground surface on opposite sides of the inductors. The antenna is restricted in practical application by the need for additional components (blocking self-inductances), bias voltage requirements and the size necessary to accommodate the capacitive radiating elements.

U.S. Pat. No. 4,564,843 to Cooper describes another capacitive radiating element connected through a series of tuning inductors to the transmitting source. Each inductor is connected to a pair of P.I.N. diodes capable of short circuiting the inductor in order to tune the antenna to different frequencies. The antenna is not a helical antenna and the inductors do not themselves serve as radiating elements. In this structure, the feeding arrangement is unbalanced with respect to the tuning coils so that very high r-f currents flow on the bias leads resulting in undesirable losses. The blocking self inductances ("chokes") L10---L33 are an absolute essential in an antenna with the described mode of operation.

U.S. Pat. No. 4,554,554 to Olesen describes an axial mode helical antenna with four separate and relatively long radiating elements surrounding a central support that are connected or disconnected by P.I.N. diodes. Antennas of this type radiate from the end with a directional pattern.

SUMMARY OF THE INVENTION

The present antenna comprises a normal model helical antenna capable of being turned electronically over a broad range of frequencies. The antenna is tuned by controlling the number of turns so that the antenna represents a quarter-wave resonant structure at the operating frequency. In the present construction, the helical turns of the radiating portion of the antenna can be formed of tubular material, such as a coaxial cable, which carries the bias wires within the turns so that no r-f currents are generated in the bias supply circuits. Turns of the helix are selectively short circuited by switches formed of P.I.N. diodes. The antenna does not require a capacitive element, although one may be provided if desired, because the primary radiation is from the helical elements. The antenna is a normal mode helix that radiates uniformly in all directions normal to the antenna in contrast to the radiation pattern of the Olesen antenna which radiates off the end in a directive pattern. The present antenna can be, for example, significantly smaller than the antennas described in the Cooper and Jaquet patents. Requirements for r-f isolation are eliminated, as required by structures such as that described in the Jaquet patent, because in the present antenna no r-f currents are generated in the bias supply wires. Furthermore, the balanced diode switching network of the present antenna, as distinguished from the diode capacitance combination of Jaquet, results in one-half the required back-biasing voltage per turn shorted which results in a four times higher power handling capability.

DESCRIPTION OF THE PREFERRED EMBODIMENTS

Figure 1:
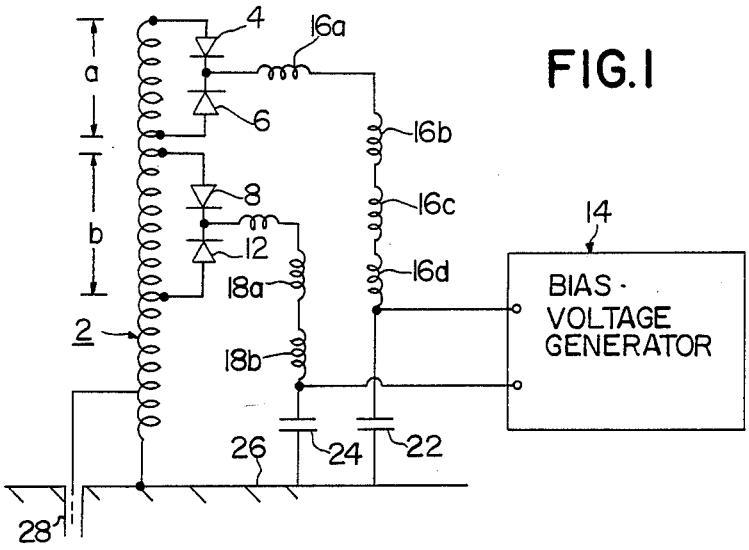
FIG. 1 is a schematic diagram for explaining the operation of applicant's antenna.

As illustrated in FIG. 1, the radiating portion of the antenna comprises a series of helical turns, generally indicated at 2. A first pair of oppositely-poled P.I.N. diodes 4-6 are connected across a section of the helix 2 indicated at "a". A second pair of oppositely-poled diodes are connected across a section of the helix indicated at "b". Bias voltage to control the diodes 4 and 6 is provided from a d-c bias voltage generator, shown in block form at 14, through series chokes **16*a*, 16*b*, 16*c* and 16*d* and connected to similar elements, i.e., cathodes, of the diodes 4 and 6. Bias voltage for the diodes 8 and 12 is also provided from the bias voltage generator 14 through the chokes 18*a* and 18*b***.

When the bias voltage is adjusted to permit the P.I.N. diodes 4 and 6 to conduct in both directions, the diodes effectively provide a short circuit across the radiating helix turns indicated at "a" thus changing the resonant frequency of the antenna system. When the bias voltage is adjusted to permit the diodes 8 and 12 to conduct in both directions, the section of the radiating turns of the helix indicated at "b" are shorted, again changing the resonant frequency of the antenna system. The bias voltage leads are maintained at ground r-f level by means of capacitors 22 and 24 connected respectively between the chokes **16*d* and 18*b* and a ground plane 26. A shunt feed connection to the antenna is made through a coaxial cable 28** that is connected to an appropriate receiver or transmitter (not shown).

The particular arrangement shown in FIG. 1 is an operative structure to achieve the desired tuning of the antenna, but has severe practical limitations. With the physical layout of the antenna control system shown in FIG. 1, the bias supply leads and the isolation inductors are exposed to the r-f field of the antenna thus introducing additional r-f currents in the network resulting in unnecessary losses in the antenna. The r-f potential between the point where the bias leads connect to the diodes and the ground plane is high: it is equal to the potential of the antenna at a point half way between the diode connection points and this results in additional r-f current in the bias network which further reduces the efficiency of the system. Moreover, the maximum power of the antenna is limited because the r-f currents become too large to be dissipated by the isolation coils. This problem is only partially overcome by the use of a number of coils in series as shown in FIG. 1. In addition to the heat dissipation problem, the heating of the coils changes the tuning of the antenna. For proper operation, the inductors or coils in the bias feed lines must be of a sufficiently high value to provide the desired isolation of the radiating turns from the ground and at the same time have a high Q for efficient operation. As a practical matter, inductors having a high Q and an inductance value high enough to provide the necessary r-f isolation are large physically and interfere with optimum performance of the antenna.

Figure 2:
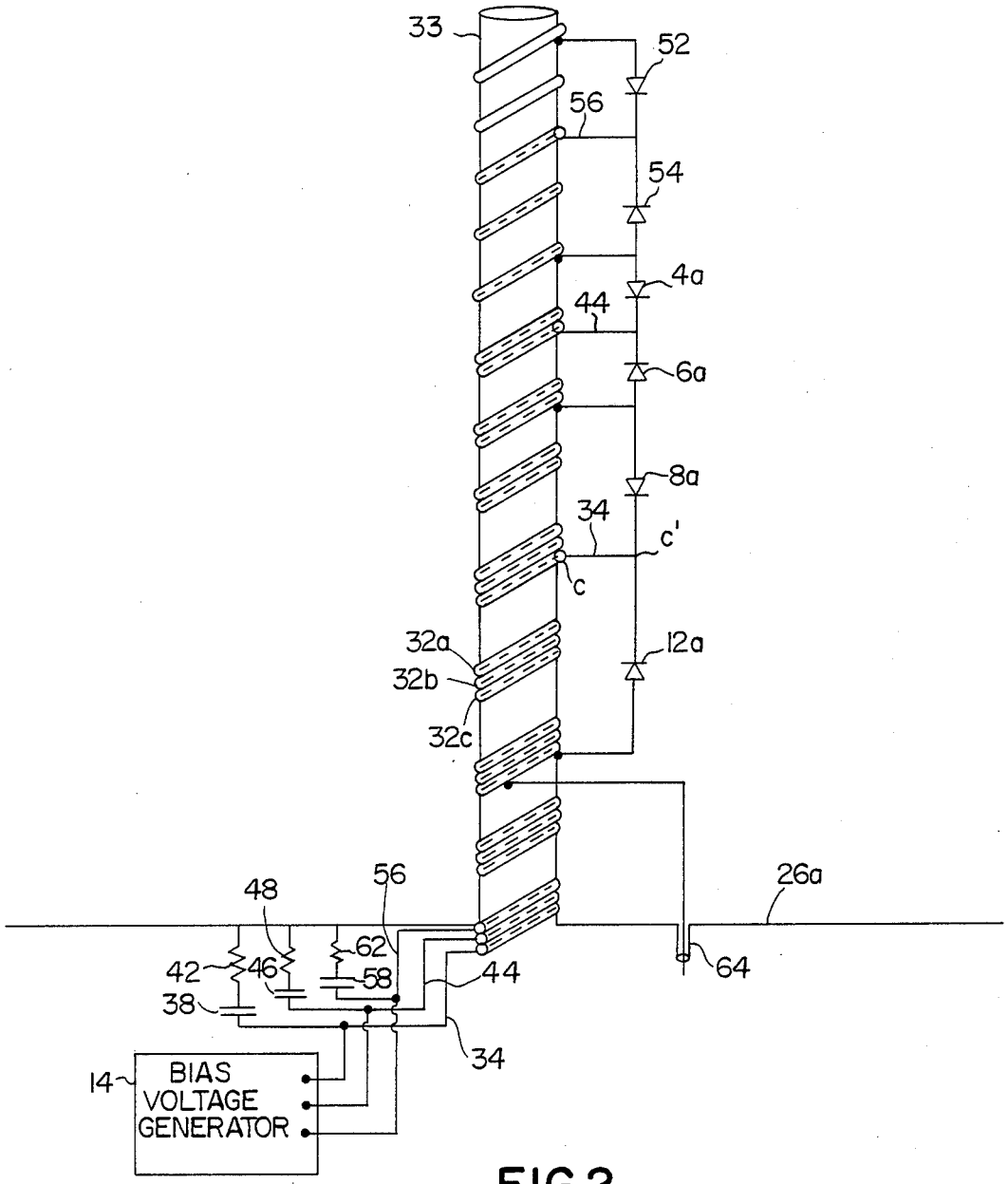
FIG. 2 is an illustration of an antenna embodying the present invention.

The performance of the antenna can be significantly improved by the arrangement shown in FIG. 2 in which the bias control circuitry is removed from the r-f field. The radiating coils of the antenna are formed by the outer conductors of three coaxial cables 32*a*, 32*b*, and 32*c* wound around a supporting shaft 33 formed of insulating material. In the lower part of the antenna the outer conductors of the three coaxial cables are electrically connected along their lengths and together provide an outer electrically-conductive structure that acts as a single helical element. This helical element is connected at its lower end to to the ground plane 26*a*. At point "c", the outer conductor of the cable 32*c* is terminated, but its inner conductor 34 is extended to connect with diodes 8*a* and 12*a* which are connected with opposite polarities across a section of the helical antenna. The point "c" is midway between the points on the radiating helix where the diodes 8*a* and 12*a* make contact. This point is referred to herein as an electrically balanced position between the points of diode connection. At the lower end of the antenna, the inner conductor 34 of the coaxial cable 32*c* is connected to a bias voltage generator 14 similar to that of FIG. 1. With the structure of FIG. 1, it would be necessary to provide one or more isolation coils between the lead 34 and the bias voltage source. With the balanced diode network shown, if diodes 8*a* and 12*a* are identical, i.e. matched, the r-f voltage at c' will be identical with the voltage at c irrespective of the bias state, resulting in no r-f voltage between the lead 34 and its outer conductor at point c. Therefore, no isolation coils are required here because of the absence of r-f currents in the bias network, but may be employed, if desired, as a safeguard in case of slight stray or unbalanced r-f currents. Further isolation, which is optional, is achieved when the lead 34 is bypassed to a ground plane 26*a* through a capacitor 38 and a series resistor 42. In this example, 50-ohm coaxial cables 32 are used and the resistor 42 is also 50 ohms to present an appropriate termination for the cable. The capacitor 38 is of sufficiently high value that it presents no significant impedance at the r-f frequency.

In FIG. 1, large r-f currents are present in the isolation coils, such as 16*a–d* and 18*a–b*, which couple to each other and induce undesired circuit resonances. In FIG. 2, the bias voltage for the diodes 8*a* and 12*a* is carried by the inner conductor of the coaxial cable 32*c* and is not subjected to induced r-f currents from the antenna field. Furthermore, no r-f voltage exists between the inner and outer conductors of the cable 32*c* at the point the bias lead 34 exits because of this network balance and, accordingly, no r-f currents flow in the coaxial cable. The absence of r-f currents and isolating coils in the bias cables eliminates the undesired resonances. If further bias line isolation is desired, to protect against small imbalances, the combination of the 50-ohm termination along with the isolating coil will result in essentially all of the residual r-f current passing through the resistor instead of the coil.

An electrically short resonant antenna develops a large r-f voltage across the structure. To control the number of turns of such a helix by the use of PIN diode switches, sufficiently large back-bias voltages are required to maintain the diodes in their open state. In the balanced diode network illustrated in FIG. 2, the r-f voltage across the diodes 8*a* and 12*a* is one-half the voltage across the turns they short out, therefor the d-c back-bias voltage requirement is one-half of what would be required if an unbalanced arrangement of a diode and capacitance, such as is shown by Jaquet, were used. In the typical application, a back-bias voltage of about 100 volts would be adequate in this design, resulting in four times the power handling capability of that achieved with an unbalanced design using the same back-bias voltage.

A second pair of oppositely-poled diodes 4*a* and 6*a* are connected across a central portion of the antenna and, when biased for conductivity in both direction, effectively short circuit that portion of the antenna. The bias voltage from the generator 14 is carried by the inner conductor 44 of the coaxial cable 32*b* to the junction of the diodes 4*a* and 6*a*. The conductor 44 is connected to the d-c bias source 14 and is coupled to ground through a capacitor 46 and a 50-ohm resistor 48 as described above.

A similar top tuning section comprises a pair of oppositely poled P.I.N. diodes 52 and 54. Bias voltage for the diodes is provided through the inner conductor 56 of the coaxial cable 32*a*. In this instance, the exit point of the inner conductor to the diodes 52 and 54 does not coincide with the termination of the outer conductor, which continues to form the remainder of the radiating turns of the antenna. The conductor 56 exits through a suitable opening or door in the outer conductor of the cable 32*a*.

At the lower end of the antenna, the inner conductor 56 is connected, as in the other sections, to the bias source 14 and is optionally by-passed to ground through a capacitor 58 and a 50-ohm resistor 62.

RF power is fed to the antenna in conventional manner through a coaxial cable 64 whose inner conductor is connected to the outer electrically-conductive structure formed by the outer conductors of cables 32*a*, 32*b* and 32*c*.

An alternate form of construction is to replace the three coaxial cables 32*a*, 32*b* and 32*c* with a single length of tubing formed into a helix with all of the bias leads inside the single length of tubing. The bias leads exit, at appropriate points, through suitable doors or openings in the tubing.

Figure 3:
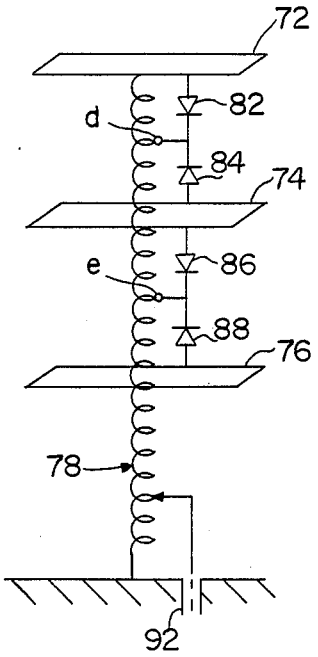
FIG. 3 is a diagrammatic representation of another form of the antenna shown in FIG. 2 including spaced capacitive radiating elements distributed along the helix.

FIG. 3 illustrates another embodiment of the invention in which three capacitance elements 72, 74 and 76 are distributed vertically along the radiating elements 78 of the helical antenna. These capacitance elements reduce the Q of the antenna system making it somewhat broader band.

The construction, other than for the capacitance elements, is the same as that illustrated by FIG. 2. The inner conductors of the coaxial cables that form the radiating elements 78 carry bias voltages to two sets of oppositely poled P.I.N. diodes. Two diodes 82 and 84 are connected in series between the capacitance elements 72 and 74. The bias voltage is connected to an inner conductor, at point "d", of the outer electrically conductive structure. The capacitance elements 72, 74 and 76 are each connected to the outer conductors of the coaxial cables. The capacitance elements may be planar metal sheets with dimensions dictated by the particular frequency range and operating characteristics desired.

Two oppositely poled P.I.n. diodes 86 and 88 are connected in series between the capacitance elements 74 and 76 and the bias lead is connected at point "e" to one of the inner conductors of the coaxial cables. Suitable bias sources and termination resistances for the coaxial cables are provided as described in connection with FIG. 2. As before, the antenna is fed in conventional manner from a coaxial cable 92.

Figure 4:
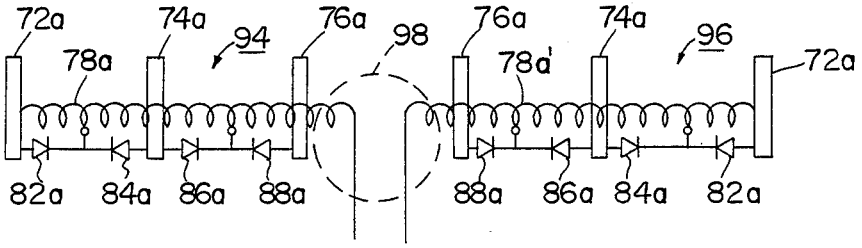
FIG. 4 is a dipole antenna using the helical structure of FIG. 2 in each of the radiating elements.

FIG. 4 illustrates a dipole antenna operating in principle like that shown in FIGS. 2 and 3. The construction of each of the side arms, generally indicated at 94 and 96, is generally similar to the vertical structures of FIG. 3 and corresponding parts bear similar numbers followed by the suffix "a".

Figure 5:
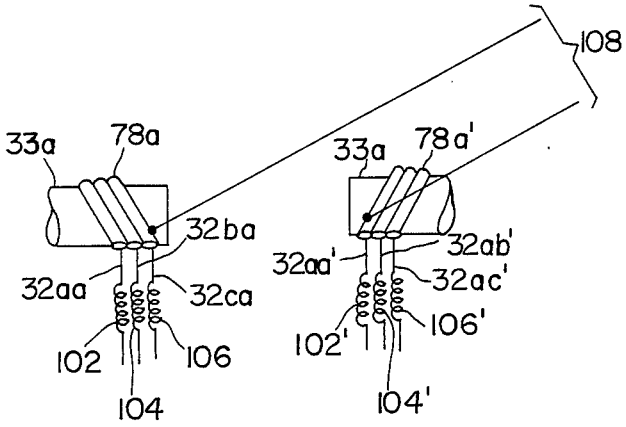
FIG. 5 is a detailed representation of the feed and biasing portions of the antenna shown in FIG. 4.

In this example, the feed arrangement is modified as illustrated by FIG. 5 which is a more detailed showing of the feed portion illustrated by the broken line circle 98. The three coaxial cables which form the helical radiating element 78*a* of the left arm carry the bias leads 32*aa*, 32*ba* and 32*ca* that, in this example, are connected respectively through isolating inductors 102, 104 and 106 to the bias voltage source 14. The three coaxial cables that form the helical radiating element 78*a'* carry the bias wires 32*aa'*, 32*ab'* and 32*ac'* that are connected respectively through isolating inductors 102', 104'; and 106'; to the bias source 14. The antenna is fed from a conventional balanced feed line 108.

I claim:

1. An electrically-turnable helical antenna comprising
a source of r-f signals,
a radiating helix coupled to said source formed of tubular material having an outer electrically-conductive structure for radiating r-f signals, said helix comprising the primary radiating element of said antenna and being resonant at the frequency of operation,
a plurality of bias leads positioned within said structure,
means for selectively applying bias voltages to said bias leads, and
a plurality of antenna tuning elements such comprising
electronically-actuated switch means including first and second serially-connected diodes connected respectively to first and second spaced points on said structure and being responsive to voltages carried by said bias leads,
a first one of said bias leads extending from said structure at an electrically balanced position between said first and second spaced points and connected to similar elements of said diodes at the junction thereof.

2. An antenna as claimed in claim 1 wherein said diodes are P.I.N. diodes.

3. An antenna as claimed in claim 1 wherein said electrically-conductive structure is formed of a plurality of coaxial cables.

4. An antenna as claimed in claim 3 including
a plurality of termination resistors each terminating one of said coaxial cables and having a value approximating the impedance of its associated coaxial cables.

5. An antenna as claimed in claim 1 including
a plurality of capacitance radiative elements connected at said spaced points to said outer electrically-conductive structure.

6. A tunable helical dipole antenna comprising
first and second outwardly extending arms each comprising
a helix formed of tubular material having an outer electrically conductive structure for radiating r-f signals,
a plurality of bias leads positioned within said structure, and
a plurality of antenna tuning elements each including
a pair of oppositely-poled diodes connected at spaced points to said structure; and
connection means extending from said structure at an electrically-balanced position between said spaced points and connecting one of said bias leads to a common junction of said diodes,
means for selectively applying bias voltages to said bias leads, and
balanced feed means connected to said outer electrically-conductive structure.

7. An antenna as claimed in claim 6 wherein said diodes are P.I.N. diodes.

8. An antenna as claimed on claim 6 wherein said tubular material comprises
a plurality of coaxial cables.

* * * * *

UNITED STATES PATENT AND TRADEMARK OFFICE

CERTIFICATE OF CORRECTION

PATENT NO. : 4,924,238

DATED : May 8, 1990

INVENTOR(S) : George Ploussios

It is certified that error appears in the above-identified patent and that said Letters Patent is hereby corrected as shown below:

On the title page:

In the Abstract, line 17: "runs" should be --turns-- line 20: "cpacitance" should be --capacitance--

Column 1, line 19: "onequarter" should be --one-quarter--

Column 4, line 40: "direction" should be --directions--

Column 5, line 25: "P.I.n" should be --P.I.N. --

In Claim 1:

Column 6, line 7: "such" should be --each--

Signed and Sealed this

Eleventh Day of September, 1990

*Attest:*

HARRY F. MANBECK, JR.

*Attesting Officer*

*Commissioner of Patents and Trademarks*